United States Patent [19]

Sanda

[11] Patent Number: 4,464,246

[45] Date of Patent: Aug. 7, 1984

[54] REAGENT AND PROCESS FOR RECOVERING OIL AND KEROGENS FROM OIL SHALE

[75] Inventor: Joseph Sanda, Surrey, Canada

[73] Assignee: Kohle Energy Research Consultants Inc., Canada

[21] Appl. No.: 319,418

[22] Filed: Nov. 9, 1981

[30] Foreign Application Priority Data

Dec. 30, 1980 [AU] Australia ..... PE07076

[51] Int. Cl.[3] ..... C10G 1/04; C09K 7/06; E21B 43/22

[52] U.S. Cl. ..... 208/11 LE; 252/8.55 D; 252/186.21; 252/187.34; 252/171; 166/307

[58] Field of Search ..... 252/8.55 D, 186.21, 252/187.34, 102, 104, 171; 166/307; 208/11 LE

[56] References Cited

U.S. PATENT DOCUMENTS

| | | | |
|---|---|---|---|
| 3,682,245 | 8/1972 | Argabright et al. | 166/270 |
| 3,763,047 | 10/1973 | Fairs | 252/351 |
| 4,014,801 | 3/1977 | Fullinwider et al. | 252/8.55 D |
| 4,046,668 | 9/1977 | Farcasin et al. | 208/11 LE |
| 4,057,486 | 11/1977 | Meadus et al. | 208/11 LE |

OTHER PUBLICATIONS

W. E. Robinson, Isolation Procedures for Kerogens and Associated Soluble Organic Materials, Chap. 6, pp. 181–193.

Kirk-Othmer, Encyclopedia of Chemical Technology, 1978, 3rd ed., vol. 3, *Antibiotics (Phenazines) to Bleach Agents*, pp. 940–943, 946, 947.

*Primary Examiner*—Richard D. Lovering
*Assistant Examiner*—Anne Brookes
*Attorney, Agent, or Firm*—Stevens, Davis, Miller & Mosher

[57] ABSTRACT

A process and reagent for the recovery of kerogen and oil from associated substrate solids and for producing pumpable liquid from high molecular weight, high viscosity crude oils in which a reagent comprising a mixture of trichloro-isocyanuric acid and a chlorine donor compound dispersed in a petroleum base solvent is mixed at ambient temperatures with the material to be treated, whereby the kerogens and oil materials are freed from solid substrate to provide a pumpable product from which the solvent may be recovered. The invention also provides a conditioning agent for use in the process comprising an intimate admixture of trichloro-isocyanuric acid and a chlorine donor compound dispersed in a petroleum base solvent.

4 Claims, 1 Drawing Figure

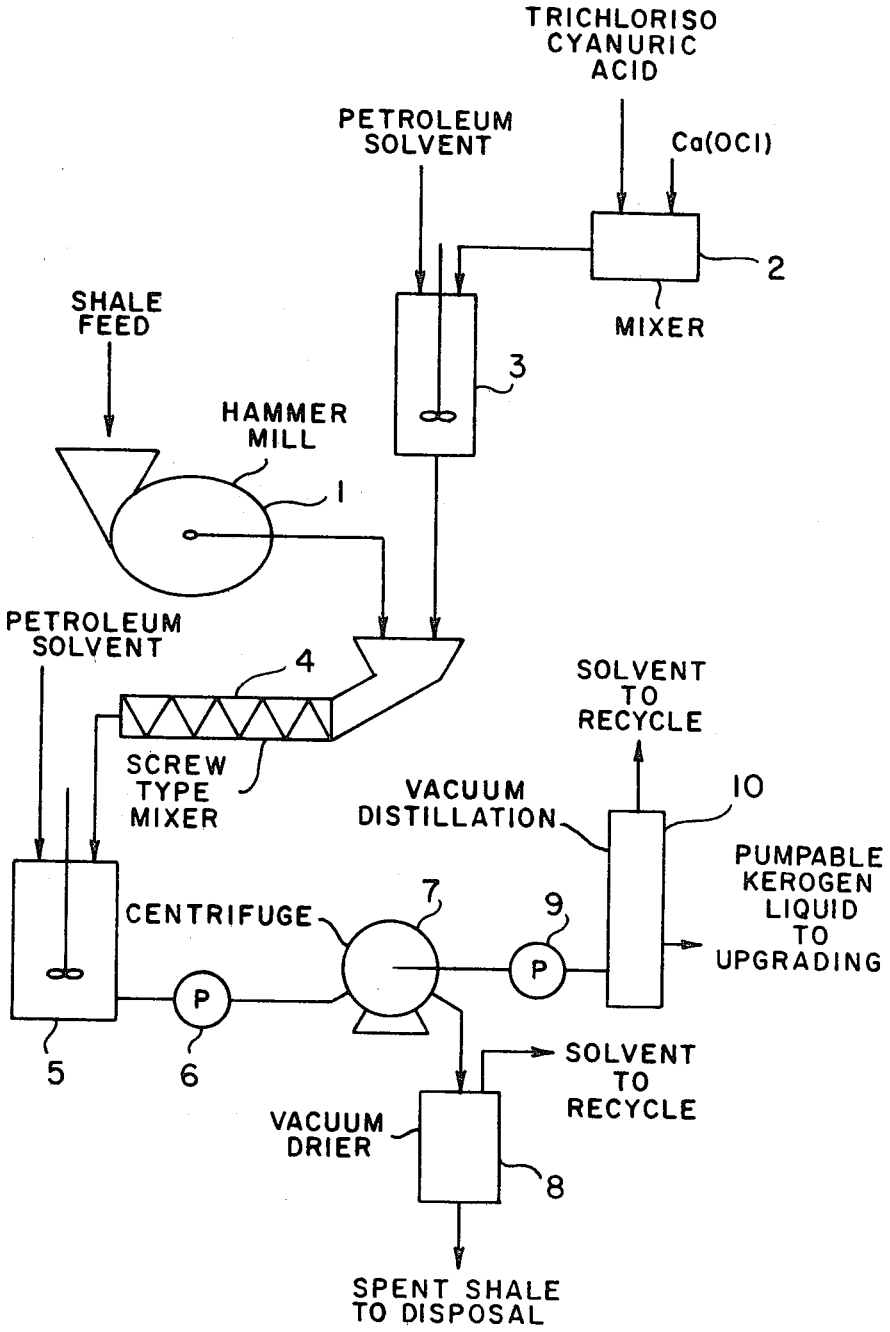
TRICHLORISO CYANURIC ACID
PETROLEUM SOLVENT
Ca(OCl)
2
MIXER
SHALE FEED
3
HAMMER MILL
1
PETROLEUM SOLVENT
4
SOLVENT TO RECYCLE
SCREW TYPE MIXER
VACUUM DISTILLATION
10
PUMPABLE KEROGEN LIQUID TO UPGRADING
CENTRIFUGE
7
9
P
P
5
6
SOLVENT TO RECYCLE
VACUUM DRIER
8
SPENT SHALE TO DISPOSAL

REAGENT AND PROCESS FOR RECOVERING OIL AND KEROGENS FROM OIL SHALE

FIELD OF THE INVENTION

This invention relates to the recovery of valuable petroleum products from naturally occurring material in which the products which it is desired to recover are in the form of high viscosity materials or apparently solid materials, and may be associated with solid substrates such, for instance, as is the case with oil shales, tar sands, so-called heavy crude oil deposits and peat.

BACKGROUND OF THE INVENTION

It is known that in the case of many oil shales and tar sands, the viscosity of the high molecular weight petroleum material may be reduced substantially by mixing such materials with a light petroleum base solvent, such as naphtha. In almost all cases, however, there remains a substantial proportion of material referred to as kerogens, which resist solubilization and which remain inextricably associated with the substrate solids causing the proposed recovery processes, based upon the use of petroleum base solvents, to be only partially effective and economically impractical.

SUMMARY OF THE INVENTION

I have now found that the high viscosity crude oil and kerogen components of oil shales, tar sands and the like may be completely disassociated from solid substrates such as host rock and fixed carbon with which they are associated, and recovered in pumpable liquid or slurry form by means of a reagent which may be applied to such materials dispersed in a petroleum base solvent whereby it is possible to achieve substantially complete separation and recovery of the bitumen kerogen and hydrocarbon content in naturally occurring materials containing high viscosity crude oil and/or kerogens.

According to my invention, the reagent employed is a mixture of trichloro-isocyanuric acid and a chlorine donor compound. The preferred chlorinated triazine compound is trichloro-isocyanuric acid. As a chlorine donor compound, I prefer to use calcium chloride, either in anhydrous form or in the form of its dihydrate. In principal, the chlorine donor compound could be any alkali metal chloride, hypochlorite, or other chlorine compound capable of releasing excess chlorine ion in the presence of water such, for instance, as any of the inorganic bleaching compounds, including free gaseous chlorine itself.

Although, in principal, the action of the reagent in releasing the kerogens from their substrate and lowering the viscosity of crude oil components that are present does not appear to depend upon any particular relative proportions of trichloro-isocyanuric acid and chlorine donor compound, it is preferred, for reasons of economics, to employ minimum relative amounts of the relatively more-expensive trichloro-isocyanuric acid compound compared to the less-expensive chlorine donor compound, such as, calcium chloride. The most economical ratio of ingredients for any particular application will be readily ascertainable by routine laboratory tests upon the material which is to be treated in any given case. A ratio of 60% by weight chlorine donor to 40% by weight trichloro-isocyanuric acid has been found to be suitable.

According to the invention, the reagent is prepared by mixing the selected proportions of e.g. calcium chloride with the trichloro-isocyanuric acid compound and then adding the resulting mixture under agitation with mild heating to a petroleum base solvent, such as naphtha. Suitably, 40 parts of reagent may be added to 60 parts of naphtha over a period of 20 to 30 minutes under agitation and gentle heating to about 25° C. to provide a solvent-reagent suspension suitable for initial mixing with comminuted raw kerogen bearing material.

In its broadest aspect, the process of the present invention provides a process and agent for the conditioning of materials containing high viscosity crude petroleum or kerogens for the recovery therefrom of valuable petroleum products which comprises contacting a mass of such material with a reagent containing an intimate admixture of a chlorinated triazine compound and a chlorine donor in the presence of a petroleum solvent, whereby to free the high viscosity crude petroleum and/or kerogen from substrate solids and produce a liquid phase containing dissolved and suspended kerogens of relatively low viscosity. In more specific aspects, the said process involves the subsequent mechanical separation of the liquid phase from substrate solids and the recovery by conventional means of various valuable kerogen and petroleum products therefrom, as well as recovery and recirculation of the solvent.

The process is adapted for continuous operation and it is an important aspect thereof that lighter fractions of petroleum released from the material being treated by the action of the solvent and the reagent employed may themselves be employed as solvents in the process, depending upon the nature of the particular material being treated. Thus, in some instances, after an initial period of continuous operation, it is contemplated that the process as applied in certain applications could become partially or wholly self-sufficient in terms of the solvent required to maintain continuous operation.

While the mechanics of the action of the reagent employed in accordance with the present invention is not fully understood, it is believed that its action involves the formation of reactive intermediates which attack the high molecular weight components, breaking them down into lower molecular weights thus reducing their viscosities. In addition to its action in chemically releasing the high viscosity oil and kerogen components from the substrate on which they occur, it appears that the reagent is also effective in breaking the higher molecular weight constituents down into substances of lower molecular weight which have substantially lower viscosities. This aspect is illustrated by the following test, carried out on a sample of Lloydminister heavy crude oil:

| SAMPLE | VISCOSITY (centipoises @ 24° C.) |
|---|---|
| Pure crude | 120,000 |
| Crude + 10% naphtha | 4,350 |
| Crude + 10% reagent* | 1,000 |

*60 parts naphtha and 40 parts reagent

The following examples illustrate the use of the reagent of the invention and the process of the invention for the recovery of liquid hydrocarbons and kerogens from oil shale on a laboratory scale.

EXAMPLE 1

200 grams of oil shale obtained from the Green River area of Colorado in the United States of America was crushed to −200 mesh. The reagent was prepared by mixing 2 grams of trichloro-isocyanuric acid with 1 gram of calcium hypochlorite in a dry laboratory mixer and then slurrying the mixture in 40 grams of naphtha in a 500 cc. beaker. The comminuted sample of oil shale was then added to the slurry and the whole was agitated vigorously for about 5 minutes. The colour of the solvent went from light to dark brown or black. Additional naphtha solvent was added to dilute the mixture to a suitable consistency for centrifuging and the whole mass was passed through a laboratory centrifuge to produce, on the one hand, a solid shale residue and, on the other hand, an oily liquid suspension. The oily liquid suspension was subjected to vacuum distillation to remove the naphtha solvent. The suspended kerogens and the liquid hydrocarbons were then separated by successive washings with naphtha solvent and final washing with alcohol to recover the kerogen in dry powder form.

There were recovered from the process 38 grams of the original 40 grams of naphtha solvent, 8 grams of liquid hydrocarbons, 5 grams of kerogens in dry powder form and 187 grams of barren shale residue.

EXAMPLE 2

A 200 gram sample of oil shale from the Green River area of Colorado in the United States of America was subjected to the same procedures as those set out in Example 1, with the exception that the reagent was prepared using 1 gram of trichloro-isocyanuric acid, 1 gram of lithium hypochlorite and 50 grams of naphtha solvent.

After working up of the product, the process yielded 49 grams of the original naphtha solvent, 8 grams of liquid hydrocarbon, 5 grams of kerogens in dry powder form and 186 grams of barren shale residue.

EXAMPLE 3

200 grams of oil shale (turbanite) from the Glen Davis area of Australia were subjected to the same procedures as those set out in Example 1, with the exception that the reagent was prepared from 1 gram of trichloro-isocyanuric acid, 1 gram of calcium hypochlorite and 40 grams of naphtha solvent.

After working up the products at the end of the procedure, the process was found to have yielded up 38 grams of the original naphtha solvent, 5 grams of kerogens in dry powder form, 40 grams of liquid hydrocarbon and 155 grams of barren shale residue.

EXAMPLE 4

200 grams of oil shale from the Queen Charlotte Islands of British Columbia, Canada were subjected to the same procedures as those set out in Example 1, with the exception that the reagent was prepared from 1 gram of trichloro-isocyanuric acid, 1 gram of anhydrous calcium chloride and 50 grams of naphtha solvent.

On working up the products at the end of the procedure, the process was found to have yielded 49 grams of the original naphtha solvent, 10 grams of kerogens in dry powder form, 7 grams of liquid hydrocarbon and 182 grams of barren shale residue.

BRIEF DESCRIPTION OF THE DRAWINGS

The process of the present invention as applied to the recovery of kerogen and petroleum products from oil shales of the general type occurring in the Queen Charlotte Islands of British Columbia, Canada will be described in conjunction with the accompanying drawing, which illustrates the process in flow sheet form.

DETAILED DESCRIPTION OF ILLUSTRATED EMBODIMENT

Referring to the flow sheet, run of pit shale is fed to hammer mill 1 in which it is reduced to a maximum particle size of approximately −200 mesh.

Reagent is prepared by adding equal proportions of trichloro-isocyanuric acid and calcium hypochlorite to the dry mixer 2, which discharges into the slurry tank 3 into which is also added the petroleum solvent so as to produce a mixture in the slurry tank 3 consisting of two parts of solids to fifty parts of petroleum solvent. In actual practice, the proportion of solids to petroleum solvent in the slurry tank 3 may vary between the proportions indicated and one part of the solids to 200 or more parts of petroleum solvent, depending upon the current composition of the feed material. The comminuted product from the hammer mill 1 and the slurry from the slurry tank 3 are fed to the inlet side of screw-type mixer 4 in a proportion of approximately one part of the slurry mixture to four parts or more of the hammer mill product so as to produce a paste-like consistency in the product emerging from the mixer 4. The product from the screw-type mixer 4 is discharged into slurry tank 5 to which is also added a sufficient quantity of petroleum solvent to provide a slurry of appropriate consistency to be pumped and subjected to the action of a centrifuge. Generally speaking, a solvent to solids ratio in the slurry tank 5 will be maintained between about 20% to 50% solids.

The slurry from slurry tank 5 is pumped by pump 6 to the centrifuge 7, which separates the relatively heavy shale particles which are discharged to vacuum dryer 8, from which the dry spent shale particles are sent to disposal and from which evaporated solvent is removed and recycled. The liquid discharged from the centrifuge is removed by pump 9 and delivered to vacuum distillation 10, which removes the solvent for recycling in the process, leaving a pumpable liquid consisting of hydrocarbons, dissolved kerogens and solid, suspended kerogen particles which are delivered to following upgrading procedures.

The result of the process is a spent shale which is virtually completely free of all organic matter and a pumpable liquid product which contains virtually the entire organic component of the shale. Indicated recoveries in terms of original organic matter content of the shale are of the order of +98%.

What I claim as my invention is:

1. A conditioning agent for use in the recovery of crude oil and substrate bound kerogen materials consisting of in intimate admixture trichloro-isocyanuric acid and calcium chloride or hypochlorite dispersed in a low viscosity petroleum base solvent.

2. A conditioning agent for use in the recovery of crude oil and substrate bound kerogen materials consisting of intimate admixture trichloro-isocyanuric acid and calcium hypochlorite dispersed in a petroleum base solvent.

3. A conditioning agent for use in the recovery of crude oil and substrate bound kerogen materials consisting of in intimate admixture trichloro-isocyanuric acid and calcium hypochlorite dispersed in solvent naphtha.

4. A process for the treatment of oil shale for the recovery therefrom of valuable liquid petroleum and kerogen products, which process consists in: contacting a dry finely divided mass of oil shale with a reagent consisting of trichloro-isocyanuric acid and calcium chloride or calcium hypochlorite in the presence of a low viscosity petroleum solvent, whereby to free the high viscosity crude petroleum and/or kerogens from substrate solids and produce an oily liquid phase of relatively low viscosity containing dissolved and dispersed kerogens; and collecting said oily liquid phase.

* * * * *